United States Patent [19]

Rosenski et al.

[11] 4,395,499

[45] Jul. 26, 1983

[54] HIGH STRENGTH PIGMENT BINDERS FOR PAPER COATINGS CONTAINING CARBOXYLATED VINYL ESTER ALKYL ACRYLIC INTERPOLYMERS

[75] Inventors: Josephine M. Rosenski, North Plainfield; Joseph M. Fernandez, Plainsboro, both of N.J.

[73] Assignee: National Starch And Chemical Corporation, Bridgewater, N.J.

[21] Appl. No.: 417,291

[22] Filed: Sep. 13, 1982

[51] Int. Cl.[3] ..... B32B 23/08; B32B 27/10

[52] U.S. Cl. ..... 523/206; 428/514; 523/205; 523/207; 524/17; 524/26; 524/53; 524/446; 524/447; 524/503; 524/555; 524/556; 524/564

[58] Field of Search ..... 428/514; 523/205, 206, 523/207; 524/17, 26, 53, 446, 447, 503, 555, 556, 564

[56] References Cited

U.S. PATENT DOCUMENTS

| | | | |
|---|---|---|---|
| 2,804,436 | 8/1957 | Ritson | 523/207 |
| 3,563,851 | 2/1971 | Armour | 428/514 |
| 4,196,253 | 4/1980 | Spence | 428/514 |
| 4,207,379 | 6/1980 | Fock et al. | 428/514 |
| 4,258,104 | 3/1981 | Lee et al. | 428/514 |
| 4,324,832 | 4/1982 | Moroff et al. | 428/514 |
| 4,341,839 | 7/1982 | Shaw et al. | 428/514 |
| 4,365,029 | 12/1982 | Reizer et al. | 428/514 |

*Primary Examiner*—Ronald W. Griffin

*Attorney, Agent, or Firm*—Edwin M. Szala; Ellen T. Dec

[57] ABSTRACT

High strength pigment binders for paper coating having increased water retention and stability are disclosed. The coating compositions comprise an aqueous synthetic polymer latex and pigment and may contain other additives used in the art of pigmented paper coating. The latex comprises a dispersed interpolymer of a vinyl ester, a polyethylenically unsaturated comonomer and a ethylenically unsaturated mono- or dicarboxylic acid and optionally an alkyl acrylate.

11 Claims, No Drawings

HIGH STRENGTH PIGMENT BINDERS FOR PAPER COATINGS CONTAINING CARBOXYLATED VINYL ESTER ALKYL ACRYLIC INTERPOLYMERS

The present invention is directed to high strength pigment binders for paper coating having increased water retention and stability. The coating compositions comprise an aqueous synthetic polymer latex and pigment and may contain other additives used in the art of pigmented paper coating. The latex comprises a dispersed interpolymer of a vinyl ester, a polyethylenically unsaturated comonomer and a ethylenically unsaturated mono- or dicarboxylic acid and optionally an alkyl acrylate.

In the preparation of a coated paper web there is used a pigment, such as clay or the like, which is then compounded with a latex binder or adhesive material to produce a composition known in the art as a coating "color" for use in coating a cellulose web, e.g. a paper or paperboard web. Substantial quantities of the binder are used, and, accordingly, the composition and characteristics of the latex binder are of great importance in determining the qualities of the finished coated web.

It has been recognized in the paper industry that increased dry strength properties may be provided to these latex binders by the inclusion therein of carboxylate functionalities. There has however been difficulty encountered in providing carboxylic functionality in excess of about 2% by weight to vinyl ester containing latex polymer compositions due to excessive alkaline swellability of the resultant latex particles. This swellability, in turn, produces unacceptable latex thickening at these pH values and consequent problems in the transport of such materials in conventional latex handling equipment where viscosities less than about 1000 cps. are generally employed.

We have now found that substantially higher levels of carboxylation, with consequent improvement in coating strength may be achieved with a reduction in alkaline swellability by incorporation in the interpolymer of one of a specific class of polyethylenically unsaturated comonomers.

The pigmented paper coating compositions of the present invention therefore comprise: an aqueous synthetic polymer latex binder, pigment and sufficient alkali to achieve a pH of 6 to 10, the latex comprising dispersed therein an interpolymer having a $T_g$ value of +30° to −′ C. which consists essentially of:

(a) a vinyl ester interpolymerized with the following comonomers:

(b) from 0 to 75% by weight of an alkyl acrylate (c) from 0.01 to 1 parts per 100 parts (a) and (b) of a polyethylenically unsaturated comonomer selected from the group consisting of triallyl cyanurate, triallyl isocyanurate, diallyl maleate, diallyl fumarate, divinyl benzene, and diallyl phthalate; and (d) from 0.5 to 15 parts per 100 parts (a) and (b) of an ethylenically unsaturated mono- or di-carboxylic acid or half ester thereof.

The vinyl ester monomers which may be utilized herein include the vinyl esters of alkanoic acids having from one to about 13 carbon atoms. Typical examples include: vinyl formate, vinyl acetate, vinyl propionate, vinyl butyrate, vinyl isobutyrate, vinyl valerate, vinyl 2-ethylhexanoate, vinyl isooctanoate, vinyl nonoate, vinyl decanoate, vinyl pivalate, vinyl versatate, etc. Of the foregoing, vinyl acetate is the preferred monomer because of its ready availability and low cost.

Generally, any ethylenically unsaturated mono or di-carboxylic acid may be used to provide the carboxyl functionality. Examples of suitable acids include the monocarboxylic ethylenically unsaturated acids such as acrylic, vinyl acetic, crotonic, methacrylic, tiglic, etc.; the dicarboxylic ethylenically unsaturated acids such as maleic, fumaric, itaconic, maleic, citraconic, hydromuconic, allylmolonic, etc. as well as the half esters of these dicarboxylic acids such as mono(2-ethylhexyl) maleate, monoethyl maleate, monobutyl maleate, etc.

The alkyl acrylate component of the interpolymer may be any straight chain or branched alkyl acrylate containing 1 to 8 carbon atoms in the alkyl portion. Representative alkyl acrylates include methyl acrylate, ethyl acrylate, hexyl acrylate, ethylhexyl acrylate, octyl acrylate and mixtures thereof. When an alkyl acrylate is employed in producing the interpolymers used herein, the particular amount of the acrylate used will depend upon the acrylate chosen as well as the desired $T_g$ to be used in the resultant polymer, however, it is generally present in amounts of from 5 to 75, preferably 10 to 50% by weight of the solids of the interpolymer.

The resultant paper coating latex compositions are characterized by reduced alkali response and increased water retention in the latex state with improved properties of dry strength imparted to the final paper sheets coated therewith.

To prepare the interpolymer latices used in the coating compositions of the invention, the vinyl ester, the optional acrylate comonomer, the polyethylenically unsaturated monomer and the carboxylic acid are interpolymerized in an aqueous medium in the presence of a catalyst, and an emulsion stabilizing amount of an anionic or a nonionic surfactant or mixtures thereof, the aqueous system being maintained by a suitable buffering agent, if necessary, at a pH of 2 to 6. The polymerization is performed at conventional temperatures from about 70° to 225° F., preferably from 120° to 175° F., for sufficent time to achieve a low monomer content, e.g. from 1 to about 8 hours, preferably from 3 to about 7 hours, to produce a latex having less than 1.5 percent preferably less than 0.5 weight percent free monomer. Conventional batch, semi-continuous or continuous polymerization procedures may be employed and are taught, for example in U.S. Pat. No. 3,563,851.

The polymerization is initiated by a water soluble free radical initiator such as water soluble peracid or salt thereof, e.g. hydrogen peroxide, sodium peroxide, lithium peroxide, peracetic acid, persulfuric acid or the ammonium and alkali metal salts thereof, e.g. anmonium persulfate, sodium peracetate, lithium persulfate, potassium persulfate, sodium persulfate, etc. A suitable concentration of the initiator is from 0.05 to 5.0 weight percent and preferably from 0.1 to 3 weight percent.

The free radical initiator can be used alone and thermally decomposed to release the free radical initiating species or can be used in combination with a suitable reducing agent in a redox couple. The reducing agent is typically an oxidizable sulfur compound such as an alkali metal metabisulfite and pyrosulfite, e.g. sodium metabisulfite, sodium formaldehyde sulfoxalate, potassium metabisulfite, sodium pyrosulfite, etc. The amount of reducing agent which can be employed throughout the copolymerization generally varies from about 0.1 to 3 weight percent of the amount of polymer.

The emulsifying agent can be of any of the nonionc or anionic oil-in-water surface active agents or mixtures thereof generally employed in emulsion polymerization procedures. When combinations of emulsifying agents are used, it is advantageous to use a relatively hydrophobic emulsifying agent in combination with a relatively hydrophilic agent. The amount of emulsifying agent is generally from about 1 to about 10, preferably from about 2 to about 8, weight percent of the monomers used in the polymerization.

The emulsifier used in the polymerization can also be added, in it entirety, to the initial charge to the polymerization zone or a portion of the emulsifier, e.g. from 90 to 25 percent thereof, can be added continuously or intermittently during polymerization.

The preferred interpolymerization procedure is a modified batch process wherein the major amounts of some or all the comonomers and emulsifier are charged to the reaction vessel after polymerization has been initiated. In this manner, control over the copolymerization of monomers having widely varied degrees of reactivity can be achieved. It is preferred to add a small portion of the vinyl ester initially and then the remainder of vinyl ester and other comonomers intermittently or continuously over the polymerization period which can be from 0.5 to about 10 hours, preferably from about 2 to about 6 hours.

The latices are produced and used at relatively high solids contents, e.g. between 35 and 70%, although they may be diluted with water if desired. The preferred latices will contain from 40 to 60, and, most preferred, from 50 to about 60 weight percent solids.

The particle size of the latex can be regulated by the quantity of non-ionic or anionic emulsifying agent or agents employed. To obtain smaller particles sizes, greater amounts of emulsifying agents are used. As a general rule, the greater the amount of the emulsifing agent employed, the smaller the average particle size.

The actual paper coating composition comprises the interpolymer latex together with a pigment, such as clay and the usual paper coating additives which may include other co-binders, such as polyvinyl alcohol, protein, e.g. casein or soy protein, or starch, as is well known to those skilled in the art.

The pigment used in the paper coating compositions may be any of those conventionally employed. Generally, at least a portion of the pigment comprises clay and for this portion any of the clays customarily used for paper coating, including the hydrous aluminium silicates of kaolin group clays, hydrated silica clays, and the specific types of clays recommended in Chapters 10–16 of "Kaolin Clays and their Industrial Uses," by J. M. Huber Corp. (1949), New York, N.Y. In addition to clay itself, there may be utilized other paper pigments such as, for example, calcium carbonate, titanium dioxide, blanc fixe, lithopone, zinc sulfide, or other coating pigments including plastics, for example polystyrene, in various ratios, e.g. up to 50%, preferably up to 35%, by weight of the clay. Additionally, the composition may also contain other additives such as zinc oxide and/or a small amount, of a dispersing or stabilizing agent such as tetrasodium pyrophosphate. In general, the paper coating composition comprises 100 parts pigment containing 65–100 parts clay and 0–35 parts secondary pigment; 0.01–0.5 parts dispersing or stabilizing agent; 3–30 parts interpolymer latex (solids basis); 0–25 parts cobinder; 0.0.2 parts defoamer and sufficient water to provide the desired level of solids. The modification and formulation of the coating color using these materials will be within the knowledge of those skilled in the art.

The coating compositions produced herein may be applied to fibrous paper webs using any of the conventional coating devices including, but not limited to, those referred to as trailing blade coaters, air knife coaters, roll coaters and the like.

The invention will now be more specially illustrated by reference to the following examples of practical application, it being understood that these examples are given for illustrative purposes only and are not to be constructed as limiting the invention.

In testing the latices and coating colors produced in the examples, the following test procedures were followed:

75° Gloss was measured using a Gardner Glossmeter.

Brookfield viscosity values were obtained using Spindle #2 at 20 rpm and/or 100 rpm as indicated.

Dry strength values on paperboard were determined using an IGT Dynamic Pick Tester, No. 5 ink, a "B" spring setting and a 35 kg. load.

Base Sheet Failure or substrate failure tests were run on offset paper stock using an IGT Dynamic Pick tester with No. 3 ink, a "B" spring setting and a 50 kg. load.

Water Retention Test: dry potassium permanganate was brushed on a sheet of Whatman #1 filter paper. The coated paper was floated (coated side up) on the liquid to be measured and the time was recorded that it took for the paper to turn purple. Longer time periods indicate higher water retention properties.

In the examples, all parts of polyethylenically unsaturated comonomers and carboxylic acid are based on parts per 100 parts by weight of the combined vinyl ester and alkyl acrylate component.

EXAMPLE I

An interpolymer was prepared using 48% butyl acrylate, 52% vinyl acetate, 0.3 parts diallyl maleate per 100 parts vinyl acetate and butyl acrylate and varying amounts of monoethyl maleate.

The Brookfield viscosity of the resultant latices (50% solids) were recorded at varying pH ranges in order to test the alkali response of the latices. For comparison purposes, a control sample containing 3 parts monoethyl maleate, but no diallyl maleate, was also tested. Viscosity values are shown in Table I.

TABLE I

| Parts | Brookfield Viscosity (Latex) | | | |
|---|---|---|---|---|
| Monoethyl Maleate | pH 4 | pH 6 | pH 7 | pH 7.5 |
| 1.5 | 90 | 130 | 130 | 140 |
| 3.0 | 40 | 60 | 200 | 450 |
| 5.0 | 40 | 60 | 600 | 1250 |
| 7.5 | 40 | 200 | 1040 | 1775 |
| 10.0 | 40 | 440 | 2050 | 3500 |
| 3.0 (Control) | 100 | 1100 | 7150 | 7600 |

As can be seen from the above results, the viscosity of the latices containing the diallyl maleate remained relatively low even at 10% carboxylation levels. In contrast, the control latex containing no diallyl maleate had an unacceptably high viscosity even at pH 7.

The resin latices were then formulated into pigment binders, i.e. coating colors, using the following components: 100 parts clay, 16 parts latex (dry weight), 0.3 parts carboxymethyl cellulose, 0.1 parts tetrasodium pyrophosphate, and 1.28 parts Berset 86 (an insolubilizer). The resultant coating colors, which at 55% solids level had a pH of 8.5, were compounded using conventional techniques known in the art of paper coating such as are described by R. H. Mosher in "The Technology of Coated and Process Papers" (Chemical Publishing Company, Inc., New York, 1952).

The coating colors were then applied to the wire side of several sheets of 125 lb./3000 ft.$^2$ bleached board to a final weight of 10 lb. per 3000 square feet. The sheets were machine calendered by 1 pass at 170° F., 200 pli. and then conditioned overnight before testing. The test results are shown in Table II.

As a control, a sample was prepared with no diallyl maleate and with 1.5 parts monoethyl maleate (the maximum level of carboxylation ordinarily used in conventional paper coating latices).

TABLE II

| Parts Monoethyl Maleate | Brookfield Viscosity (color) 20 rpm | 100 rpm | 75° Gloss | IGT |
|---|---|---|---|---|
| 1.5 | 650 | 225 | 43 | 528 |
| 3.0 | 650 | 235 | 43 | 503 |
| 5.0 | 1000 | 340 | 45 | 588 |
| 7.5 | 1775 | 590 | 38 | 585 |
| 10.0 | 2550 | 85 | 35 | 570 |
| 1.5 (control) | 625 | 220 | 40 | 375 |

As the above results show, the dry strength of the coating color (as measured by IGT values) is substantially increased by the use of both the diallyl maleate and the monoethyl maleate.

Another set of coating colors were similarly prepared using the latex with 1.5 parts and 3.0 parts monoethyl maleate but with no diallyl maleate. These control samples were then tested and compared with a coating color prepared in accordance with the teachings of the invention and containing 3 parts monoethyl maleate and 0.3 parts diallyl maleate. Testing results are shown in Table III.

TABLE III

| Parts Diallyl Maleate | Parts Monoethyl Maleate | Brookfield Viscosity (Color) pH 8.5 20 rpm | pH 8.5 100 rpm | pH 10 20 rpm | pH 10 100 rpm | IGT |
|---|---|---|---|---|---|---|
| — | 1.5 | 550 | 195 | 575 | 215 | 375 |
| — | 3.0 | 825 | 285 | 1150 | 390 | 433 |
| 0.3 | 3.0 | 625 | 215 | 700 | 250 | 505 |

As is seen from the above, the presence of both the diallyl maleate and the monoethyl maleate in the interpolymer latex synergistically improves the dry strength (IGT) values and also reduces the alkali sensitivity of the coating color as is particularly apparent from the comparison of the Brookfield viscosities run at pH 10.

EXAMPLE II

Using the procedure described in Example I, a similar series of latices containing 75% vinyl acetate, 25% butyl acrylate, 0.3 parts diallyl maleate and various amounts of monoethyl maleate were prepared and coating colors (at pH 8.5) formulated therewith tested. The testing data on the coating colors are shown in Table IV.

TABLE IV

| Parts Monoethyl Maleate | Brookfield Viscosity (Color) 20 rpm | 100 rpm | 75° Gloss | IGT |
|---|---|---|---|---|
| 1.5 | 625 | 225 | 43 | 487 |
| 5.0 | 1625 | 540 | 40 | 535 |
| 1.5 (no diallyl maleate) | 675 | 230 | 45 | 403 |

As in Example I, the presence of the polyethylenically unsaturated comonomer in the interpolymer facilities the higher level of carboxylation with resultant increase in strength in coating colors formulated therewith.

EXAMPLE III

Additional interpolymers were prepared and coating colors formulated therewith using resins based on polyvinyl acetate and on copolymer of 30% vinyl acetate and 70% butyl acrylate. As control, another interpolymer was prepared from 100% vinyl acetate and 0.74 parts monoethyl moleate as is used in conventional polyvinyl acetate paper coating binders. The Brookfield viscosity values of the latices at various pH levels as well as the gloss and IGT values of the coating colors are shown in Table VI.

The composition of the interpolymers tested are designated in Table V:

TABLE V

| Composition | Vinyl Acetate | Butyl Acrylate | Diallyl Maleate | Monoethyl Maleate |
|---|---|---|---|---|
| A | 100 | — | — | 3.0 |
| A-1 | 100 | — | — | 4.0 |
| B | 100 | — | 0.15 | 3.0 |
| B-1 | 100 | — | 0.15 | 4.0 |
| C | 30 | 70 | — | 15 |
| D | 30 | 70 | 0.5 | 15 |
| E | 100 | — | — | 0.75 |

TABLE VI

| Composition | Brookfield Viscosity (Latex) pH 7 | 7.5 | 8.0 | Coating Color Properties 75° Gloss | IGT |
|---|---|---|---|---|---|
| A | 100 | 700 | 75000* | ** | ** |
| A-1 | ** | ** | ** | 42 | 460 |
| B | 75 | 400 | 28000* | ** | ** |
| B-1 | ** | ** | ** | 42 | 497 |
| C | 12200 | 12800 | 13200 | 48 | 258 |
| D | 20 | 50 | 50 | 47 | 428 |
| E | 100 | 100 | 100 | 42 | 387 |

*Dilatent
**Not Measured

EXAMPLE IV

The latex binder prepared in Example I using 5 parts monoethyl maleate was formulated into a commercial paper coating color containing 100 parts pigment, 18 parts starch co-binder and 5 parts latex. The coating color was used at 58% solids, pH 7.2 and coated onto several sheets of 30 lb. offset rawstock to a final coat weight of 4 lb. dry coat per 3300 per square feet. The sheets were treated as described above the calendered by 4 passes at 140° F. and 600 pli. In order to better illustrate the reduction in alkali sensitivity, Brookfield viscosity measurement of the coating colors were also made at pH 9.8.

The binders were compared to a control containing no crosslinking or carboxylation.

TABLE VII

| | Brookfield Viscosity (Color) | | | | Base Sheet Failure | |
|---|---|---|---|---|---|---|
| | pH 7.2 | | pH 9.8 | | Fiber | Fiber |
| | 20 rpm | 100 rpm | 20 rpm | 100 rpm | Lift | Pick |
| Control | 12500 | 4260 | 14800 | 4960 | 220 | 370 |
| Example IV | 11800 | 3960 | 15200 | 5100 | 420 | 630+ |

The results observed indicated not only the improved dry strength of the resultant coating colors but also the improved water retention properties of the colors apparent from the differences in base sheet failure which is influenced by the water holding capabilities of the latex. Additionally, the water retention properties of the respective latices were tested and the latex of the Example gave a value of 30 seconds while the control latex had a retention value of only 3 seconds.

EXAMPLE V

In order to show the specificity of the particular polyethylenically unsaturated comonomeric cross-linking agent utilized herein, interpolymers were prepared with a variety of the conventionally recognized cross-linking agents.

| | Crosslinking agent | |
|---|---|---|
| Group I | Triallyl cyanurate | |
| | Triallyl isocyanurate | |
| | Diallyl fumarate | |
| | Divinyl benzene | |
| | Diallyl phthalate | |
| Group II | Trimethylol proporitri-acrylate | Did not exhibit cross-linking |
| | 1,6-hexandiol diacylate | Did not exhibit cross-linking |
| | Tetraallyloxyethane | Did not exhibit cross-linking |
| | Trimethyl propane diallyl ether | Did not exhibit cross-linking |

When coating colors are prepared with the crosslinking agents shown in Group I, improvements in dry strength, alkali resistance and water retention comparable to those observed with diallyl maleate will be obtained. Additionally, when interpolymers are prepared using other vinyl esters, other alkyl acrylate copolymers, and/or other carboxyating agents comparable results will be obtained.

Now that the preferred embodiments of the present invention have been described in detail, various modifications and improvements thereon will become readily apparent to those skilled in the art. Accordingly, the spirit and scope of the present invention is to be limited only by the appended claims, and not by the foregoing disclosure.

What is claimed is:

1. A pigmented paper coating composition comprising an aqueous synthetic polymer latex binder, pigment and sufficient alkali to achieve a pH of 6 to 10, the latex comprising dispersed therein an interpolymer having a $T_g$ value of +30° to −40° C. which consists essentially of:

(a) a vinyl ester of an alkanoic acid having one to 13 carbon atoms interpolymerized with the following comonomers:

(b) from 0 to 75% by weight of an alkyl acrylate;

(c) from 0.01 to 1 parts per 100 parts (a) and (b) of a polyethylenically unsaturated comonomer selected from the group consisting of triallyl cyanurate, triallyl isocyanurate, diallyl maleate, diallyl fumarate, divinyl benzene and diallyl phthalate; and (d) from 0.5 to 15 parts per 100 parts (a) and (b) of an ethylenically unsaturated mono- or dicarboxylic acid or the half esters thereof.

2. The composition of claim 1 wherein the carboxylic acid component of (d) is selected from the group consisting of acrylic acid, vinyl acetic acid, crotonic acid, methacrylic acid, tiglic acid, maleic acid, fumaric acid, itaconic acid, maleic acid, citraconic acid, hydromusonic acid, and allylmolonic acid, mono(2-ethylhexyl) maleate, monoethyl maleate and monobutyl maleate.

3. The composition of claim 1 wherein the alkyl acrylate contains 1 to 8 carbon atoms in the alkyl portion thereof.

4. The composition of claim 3 wherein the alkyl acrylate is butyl acrylate.

5. The composition of claim 1 wherein the vinyl ester is selected from the group consisting of vinyl formate, vinyl acetate, vinyl propionate, vinyl butyrate, vinyl isobutyrate, vinyl valerate, vinyl 2-ethylhexanoate, vinyl isooctanoate, vinyl nonate, vinyl decanoate, vinyl pivalate and vinyl versatate.

6. The composition of claim 5 wherein the vinyl ester is vinyl acetate.

7. The composition of claim 1 wherein the interpolymer consists essentially of 50–90% vinyl acetate, 10–50% butyl acrylate, 0.2–0.4 parts diallyl maleate and 3–5 parts monoethyl maleate per 100 parts vinyl acetate and butyl acrylate.

8. The composition of claim 1 wherin the coating comprises 100 parts of the pigment, 0.01–0.5 parts dispersing agent, 3–30 parts (solids) latex, 0–25 parts cobinder, 0–0.2 parts defoamer and sufficient water to obtain a solids level of 35 to 70 weight percent.

9. A fibrous web coated with the pigmented paper coating composition of claim 1, said coating being that deposited upon the evaporation of water from the aqueous coating composition applied to said web.

10. A fibrous web as defined in claim 9 wherein said composition has a solids content of 35 to 70% and said latex is present, on a latex solids basis, in the amount of 3 to 30 parts by weight per 100 parts of said pigment.

11. A method for coating a fibrous web which comprises applying to said web the aqueous pigmented paper coating composition of claim 1.

* * * * *